US006314600B1

(12) United States Patent
Cachot

(10) Patent No.: US 6,314,600 B1
(45) Date of Patent: Nov. 13, 2001

(54) MULTIFUNCTIONAL POCKET TOOL

(75) Inventor: Maurice Cachot, Delémont (CH)

(73) Assignee: Wenger SA, Delémont (CH)

( * ) Notice: Subject to any disclaimer, the term of this patent is extended or adjusted under 35 U.S.C. 154(b) by 0 days.

(21) Appl. No.: 09/229,888

(22) Filed: Jan. 14, 1999

(30) Foreign Application Priority Data

Jan. 21, 1998 (EP) ..... 98810028

(51) Int. Cl.[7] ..... B25B 7/22
(52) U.S. Cl. ..... 7/128; 7/168; 81/490
(58) Field of Search ..... 7/118, 125, 126, 7/127, 128, 129, 132, 167, 168; 81/177.4, 490

(56) References Cited

U.S. PATENT DOCUMENTS

| | | | | |
|---|---|---|---|---|
| D. 338,386 | * | 8/1993 | Frazer | 7/168 |
| D. 367,807 | * | 3/1996 | Hung | 7/168 |
| 4,512,051 | * | 4/1985 | Magan | 7/128 |
| 4,888,869 | | 12/1989 | Leatherman . | |
| 4,934,223 | * | 6/1990 | Wong | 7/167 |
| 5,251,353 | * | 10/1993 | Lin | 7/128 |
| 5,267,366 | * | 12/1993 | Frazer | 7/128 |
| 5,421,225 | | 6/1995 | Chen . | |
| 5,499,562 | | 3/1996 | Feng . | |
| 5,517,885 | * | 5/1996 | Feng | 81/490 |
| 5,522,291 | | 6/1996 | Liu . | |
| 5,566,596 | * | 10/1996 | Lin | 81/490 |
| 5,711,194 | * | 1/1998 | Anderson et al. | 7/168 |
| 5,782,150 | * | 7/1998 | Huang | 81/490 |
| 5,918,513 | * | 7/1999 | Ho | 81/490 |
| 5,960,498 | * | 10/1999 | Nabors et al. | 7/128 |
| 6,023,805 | * | 2/2000 | Lin | 7/128 |
| 6,082,232 | * | 7/2000 | Anderson et al. | 7/168 |

FOREIGN PATENT DOCUMENTS

| | | |
|---|---|---|
| 94 03 314.5 | 4/1995 | (DE) . |
| 297 15 330 U1 | 12/1997 | (DE) . |
| 0 744 251 A2 | 11/1996 | (EP) . |
| 0 776 737 A1 | 6/1997 | (EP) . |
| 0 782 903 A1 | 7/1997 | (EP) . |

OTHER PUBLICATIONS

Feb. 9, 2000 Translated Office Action from Japanese Patent Office for corresponding application.

* cited by examiner

*Primary Examiner*—Joseph J. Hail, III
*Assistant Examiner*—Joni B. Danganan
(74) *Attorney, Agent, or Firm*—Oliff & Berridge, PLC

(57) ABSTRACT

Multifunctional knife/cutting pliers comprising two lateral sides serving as a handle for the tool and surrounding an interior space. At least one other implement is disposed in this interior space so as to pivot about a transverse axis connecting the two lateral sides.

The knife/cutting pliers further comprises a plurality of removable implements to which the user can have access by lifting up a magazine lid over at least one portion of this interior space. The implements are held in the lid by a plurality of corresponding accommodations.

55 Claims, 6 Drawing Sheets

MULTIFUNCTIONAL POCKET TOOL

This invention concerns a multifunctional pocket tool comprising two lateral sides, serving as a handle for the tool, and an interior space between said sides. This invention likewise concerns a multifunctional pocket tool of the magazine or container type, able to contain a plurality of removable implements. This invention also concerns a magazine lid for a multifunctional pocket tool.

BACKGROUND

In classic multifunctional pocket knives, such as the Swiss knives, the screwdrivers are generally not detachable, It is consequently necessary to provide a great number of different screwdrivers on the knife. It is impossible, however, to provide as many screwdrivers as desired, Moreover, the Phillips-head screwdrivers and the hexagonal attachments of large size are difficult to integrate into the knife owing to their great thickness which takes up the space of several conventional intmplements.

The patent EP 0 782 903 in the name of the present applicant describes a knife/cutting pliers including an aperture in one of the lateral sides to receive diverse removable attachments, for example for screwdrivers or hexagonal attachments. This arrangement makes it possible to use the attachments with a moment of great force and without risk of folding an implement back into the interior of the knife. This knife/cutting pliers is thus less likely to injure the user.

The different removable attachments described in this patent have to be carried in a leather or cloth case separate from the knife, increasing the total bulk of what the user has to carry around. This document also suggests carrying the removable implements in one or more compartments inside the knife /cutting pliers, without, however, indicating how these implements can be integrated.

OBJECTS AND SUMMARY OF THE INVENTION

One object of the invention is therefore to propose a multifunctional pocket tool not having the mentioned drawbacks of prior art tools.

In particular, one object of the invention is to propose a multifunctional pocket tool allowing a plurality of removable implements to be transported in the body of the tool.

These objects are attained according to the invention by means of a multifunctional pocket tool comprising two lateral sides, serving as a handle for the tool, and an interior space between said sides, characterized by a plurality of removable implements to which the user can have access by lifting up a magazine lid covering, in closed position, at least one portion of said interior space.

These objects are also attained according to the invention by means of a magazine lid for a multifunctional pocket tool with two lateral sides, serving as a handle for the tool, and an interior space between said sides, wherein the magazine lid is intended to receive different removable implements, and wherein it comprises a snapping system allowing it to be fixed to, and disunited from, said pocket tool.

BRIEF DESCRIPTION OF THE DRAWINGS

The invention will be better understood from reading the description, given by way of example and illustrated with the attached figures.

DETAILED DESCRIPTION OF EMBODIMENTS

Figure 1:
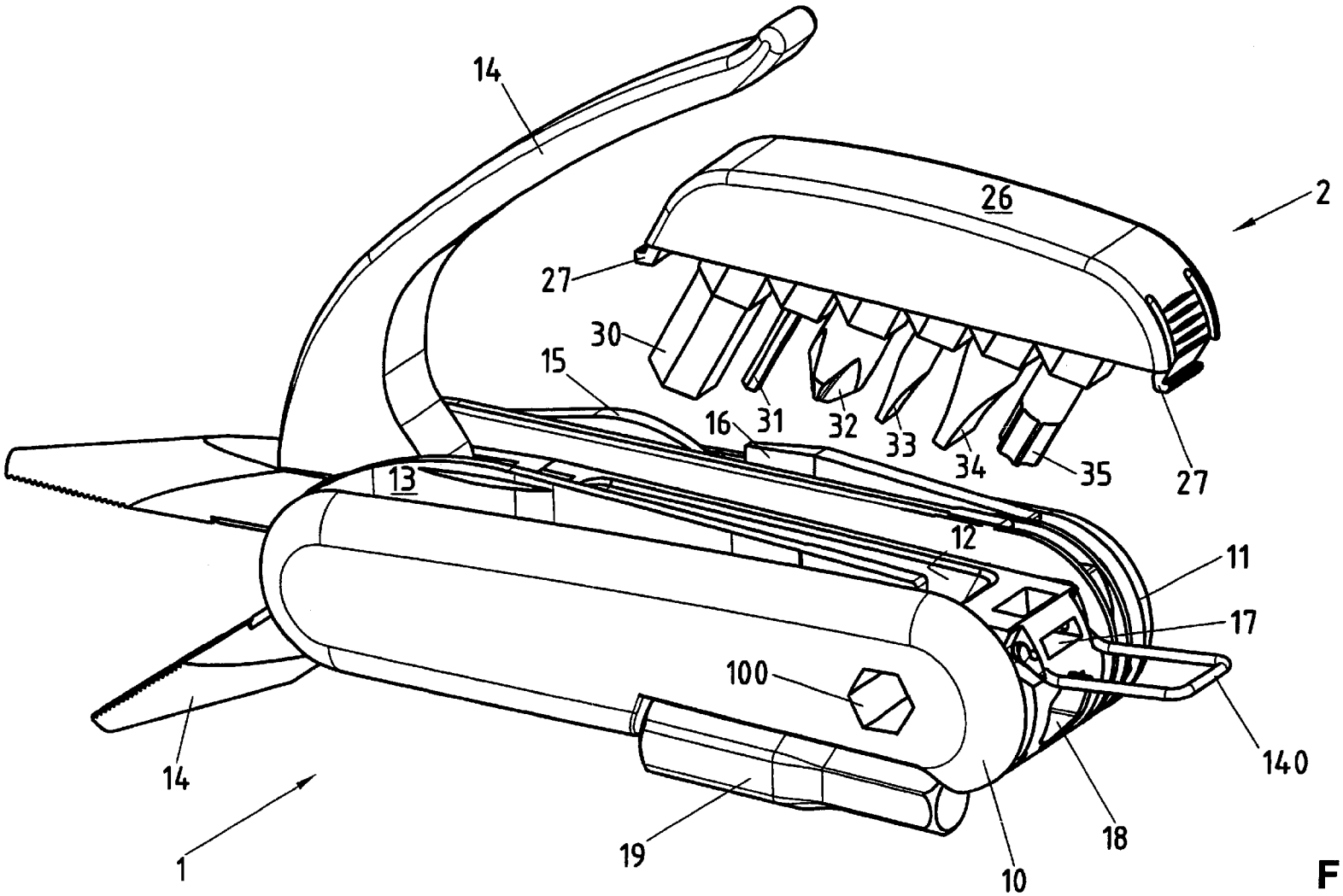
FIG. 1 is a view in perspective of a knife/cutting pliers according to the invention with the pliers in an open position and a magazine lid in an exploded view.

Although the example described relates more specifically to a knife/cutting pliers equipped with a magazine for removable attachments, it is important to understand that the invention can likewise apply to other types of multifunctional tools able to receive any type of removable implement, in particular, for example, multifunctional knives of the knife/cutting pliers type, knives equipped with an extension of the open end adjustable wrench type or versatile knives equipped with pruning shears.

The knife/cutting pliers 1 comprises in this example a universal pliers, one of whose grips or blades is fixed, and the other can be actuated by a pliers handle 14. Other implements, for example a large knife blade 13, a can opener 15 and a bottle opener 16 are also disposed in an interior space 12 between the sides of the knife/cutting pliers and can be taken out therefrom by making them pivot about a transverse axis (not shown), as in ordinary folding penknives. The interior space 12 is at least partially closed off in the back of the knife (below on the face 3) by the flexible spring blades of known type acting upon the implements 13 to 16.

Figure 5:
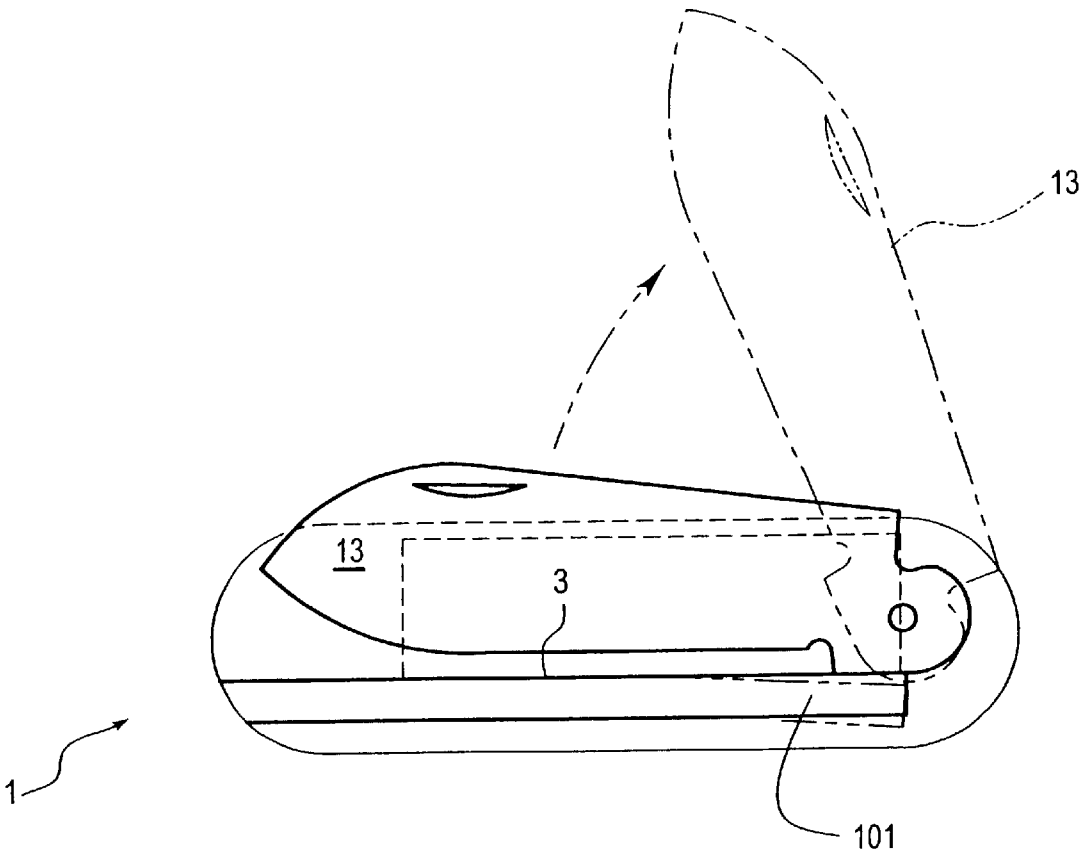
FIG. 5 is a side view taken along plane 5—5 of FIG. 3.
Figure 6:
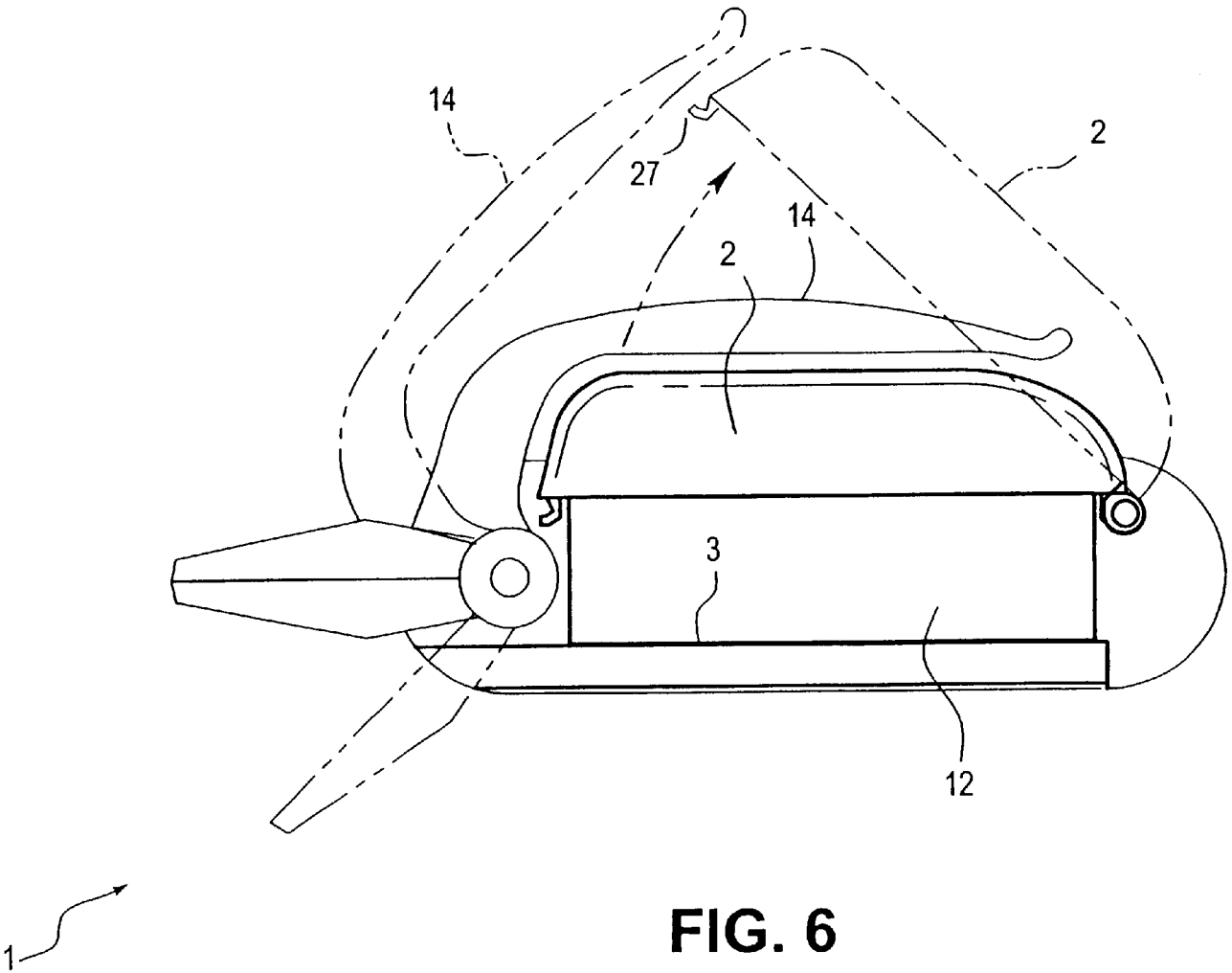
FIG. 6 is a side view taken along plane 6—6 of FIG. 3.

FIGS. 5 and 6 show the face 3 of the space 12 and flexible spring blades 101.

The sides 10, 11 of the knife are preferably of metal possibly covered by a molded or injected plastic. They can, however, also be made of any other material, for example horn, wood, etc., depending upon the aesthetic look one wishes to give the knife. Generally, the two sides 10, 11 comprise parallel inner faces defining an interior space 12 in which different implements are arranged in parallel, and outer faces adapted ergonomically to the hand of the user, for example symmetrical.

In a variant, one or more implements can be taken out by making them slide longitudinally between the two inner faces of the sides 10 and 11, as in the known knives having a catch. The invention nevertheless applies to any type of versatile tool comprising one or more retractable implements. In particular, the invention also applies to folding knives comprising blades able to be folded up into hollow handles, such as described, for example, in U.S. Pat. No. 4,888,869. The faces of the hollow handles of this type of nippers are analogous and equivalent to the sides of the penknife.

Other implements, for example an attachment extension piece 19 or tweezers (not shown) can moreover be directly accommodated in or against the sides 10, 11 of the knife/cutting pliers 1.

Figure 4:
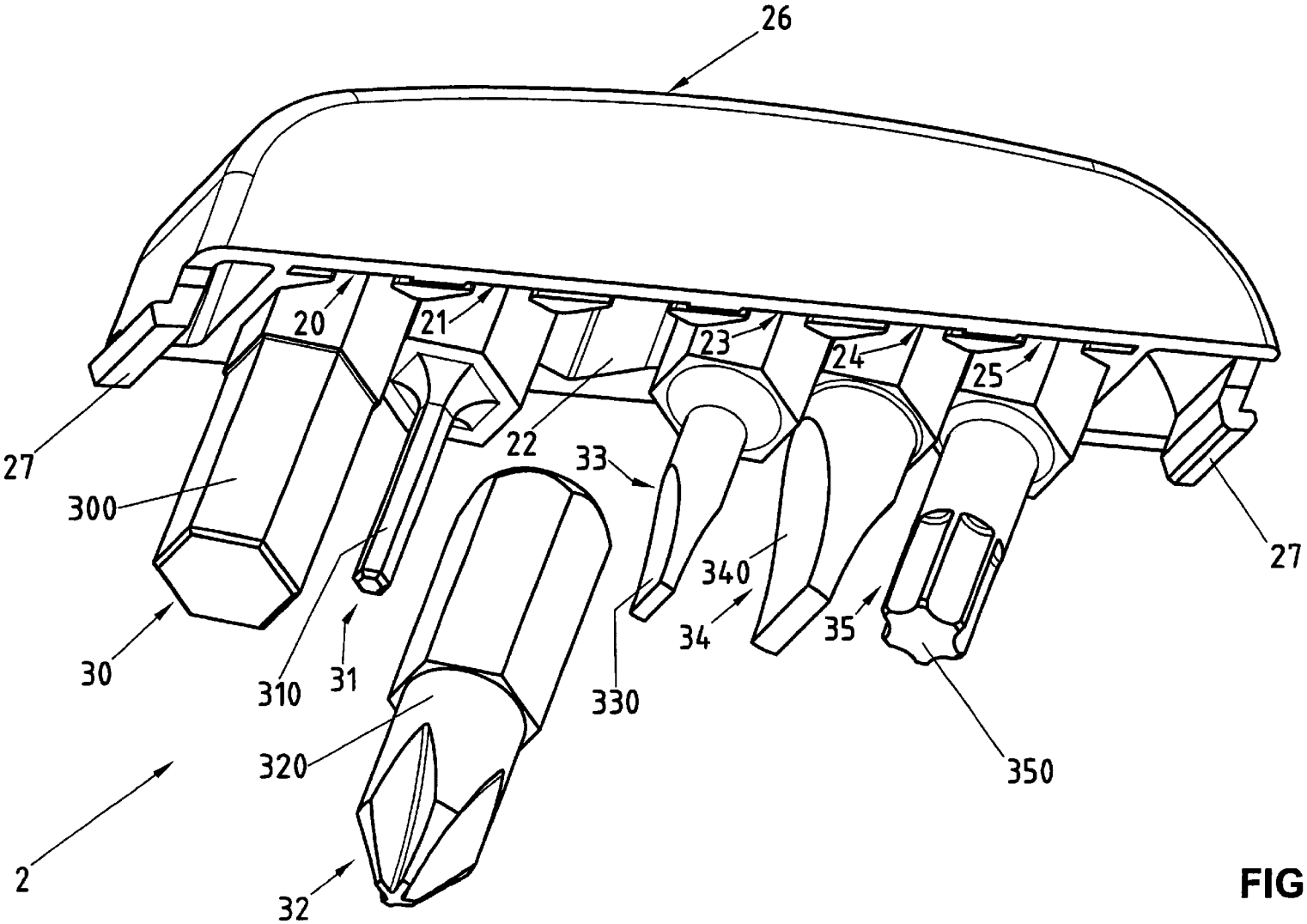
FIG. 4 is an exploded view of a magazine lid equipped with implements according to the invention.

According to the invention, the tool 1 comprises furthermore a plurality of removable implements 30, 31, 32, 33, 34, 35 to which the user can have access by lifting up the magazine lid 2 over the interior space 12 between the sides of the tool. In the example shown, the removable implements consist of standardized attachments able to be used also, for example, in ratchet sets or in combination with screw-driving machines. The different attachments shown in particular in FIG. 4 correspond in this example to two hexagonal tips 30, 31, a double offset screwdriver 32 for recessed head screws, two straight screwdrivers 33, 34 and a six-sided implement 35. However, one skilled in the art will understand that, depending upon the foreseen application of the knife, there can be access to other different removable implements by lifting up the lid, for example to other kinds of attachments of any known type, for example a socket wrench, flat screwdriver, Phillips-head screwdriver, etc. It is likewise possible to use to implements other than screwing tips, for example a corkscrew, a stamp, or instruments of a different type such as a safety pin, pencil, mirror, thermometer, etc.

The removable implements 30–35 are held by accommodations of corresponding shape 20 to 25 in the lid 2. In the example shown, all the accommodations are similar; it is evident that, depending upon the type of implement provided, other shapes and sizes of accommodations or any other type of hooking means can be provided in the lid 2. It is also possible to fix at least certain implements to the knife 1, through accommodations or hooking means disposed on the interior of the space 12, and even dispose implements loosely in the space 12, without fixing them to the lid 2 nor to the knife 1. This latter solution is particularly suited to implements of the first aid kit type, for example. Preferably, however, only one portion of the implements is held by a corresponding accommodation in the lid, whereas the rest of each implement extends projecting into the space 12. It is thus possible to take hold easily of the removable implements when the lid 2 is raised. Preferably, the projecting portion 300, 310, 320, 330, 340, 350 of each implement allows it to be distinguished visually from the other implements.

The removable implements are preferably arranged parallel in the space 12, in an oblique direction with respect to the longitudinal axis of the knife 1, so that sufficiently long implements can be inserted into a tool 1 of little thickness. Moreover, the implements are preferably arranged in such a way as to occupy a single attachment thickness in the knife. It is evident, however, that depending upon the type and the size of the implements used, very different arrangement systems can be adopted.

The lid 2 can be disunited from the body of the knife 1 by disengaging the flexible snap means 27 from the corresponding apertures 17 in the knife/cutting pliers. The means 27 are made up in this case of a plastic or steel hinge; other embodiments, for example spring or clip means, can easily be imagined by one skilled in the art for releasing and hooking the lid 2 to the knife 1 without supplementary tools.

FIGS. 5 and 6 show the hinge that connects the lid 2 to the body of the knife 1.

The lid 2 preferably comprises a flat surface 26 allowing it to be placed, for example, on a table to have easy access to the implements 30 to 35. The shape of the accommodations 20 to 25 is preferably such that the corresponding implements 30 to 35 can be lifted up with the lid without falling out. For example, snap means can be provided at the bottom of the accommodations 20 to 25, or the play between the accommodations and the implements can be adjusted in such a way as to allow insertion or withdrawal of the implements only with a certain force. Corresponding snap means will also be preferably provided if the interior space 12 is furnished with accommodations.

As indicated, it is also possible to transport the implements loosely in the interior space 12; in this case, it is possible to use a lid and an interior space devoid of accommodations and hooking means, or in any case provide at least fewer hooking means than implements transported.

In a variant not shown, the lid 2 is not completely detachable, but remains integral with the knife, for example by means of a hinge on one of the longitudinal ends of the lid. In this variant, only the other end of the magazine lid can be lifted up to gain access to the implements. This variant has the advantage of diminishing the risk of loss of the lid, however at the cost of more difficult disengagement of the implements. The hinge, for example, can be articulated about a transverse axis in the same way as the common blades of the knife 1; the flexible back blades in the back of the knife can then force the lid into three predefined positions at 0°, 90° or 180° with respect to the longitudinal axis of the knife.

Figure 2:
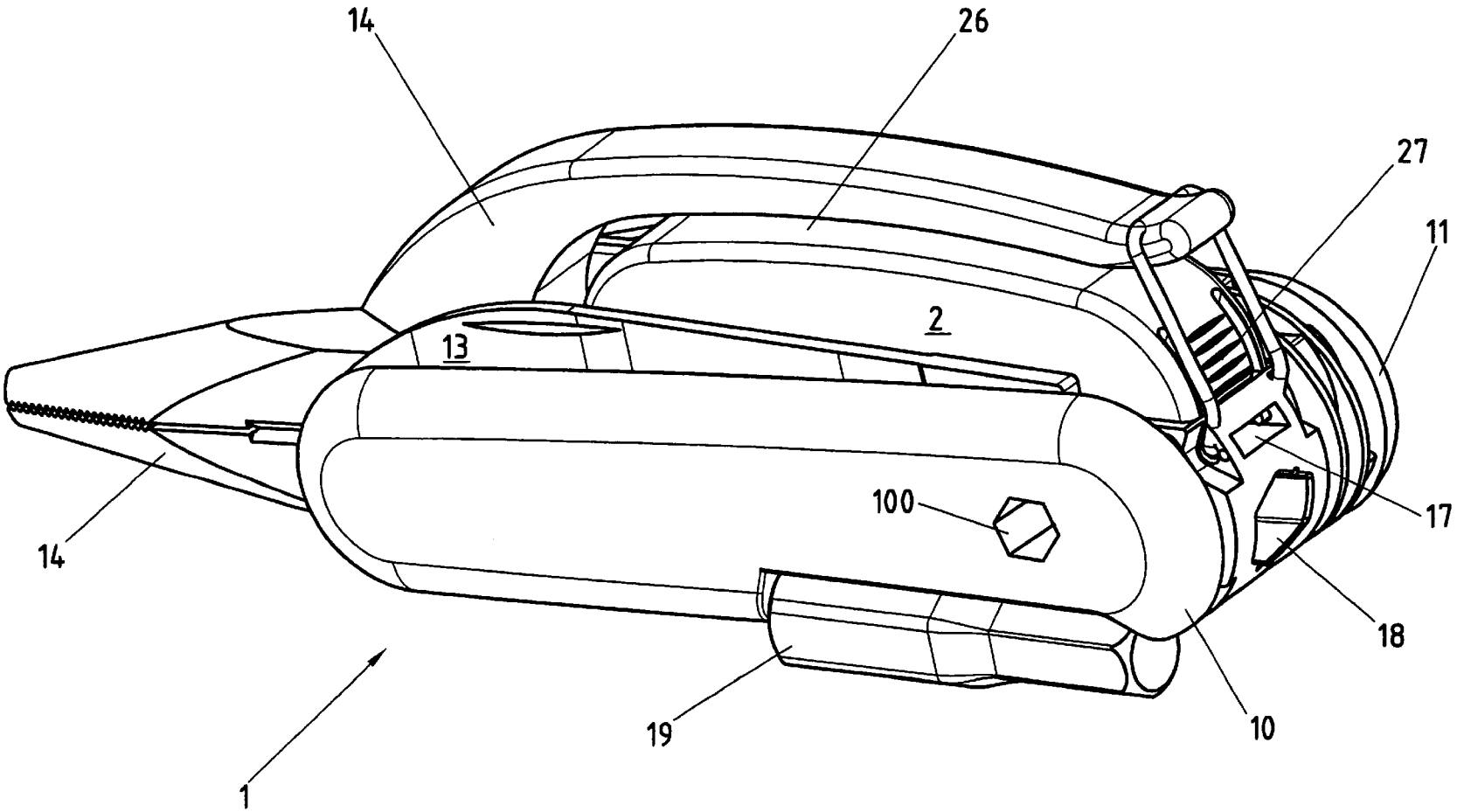
FIG. 2 is a view in perspective of a knife/cutting pliers according to the invention with the pliers in closed position and a closed magazine lid.
Figure 3:
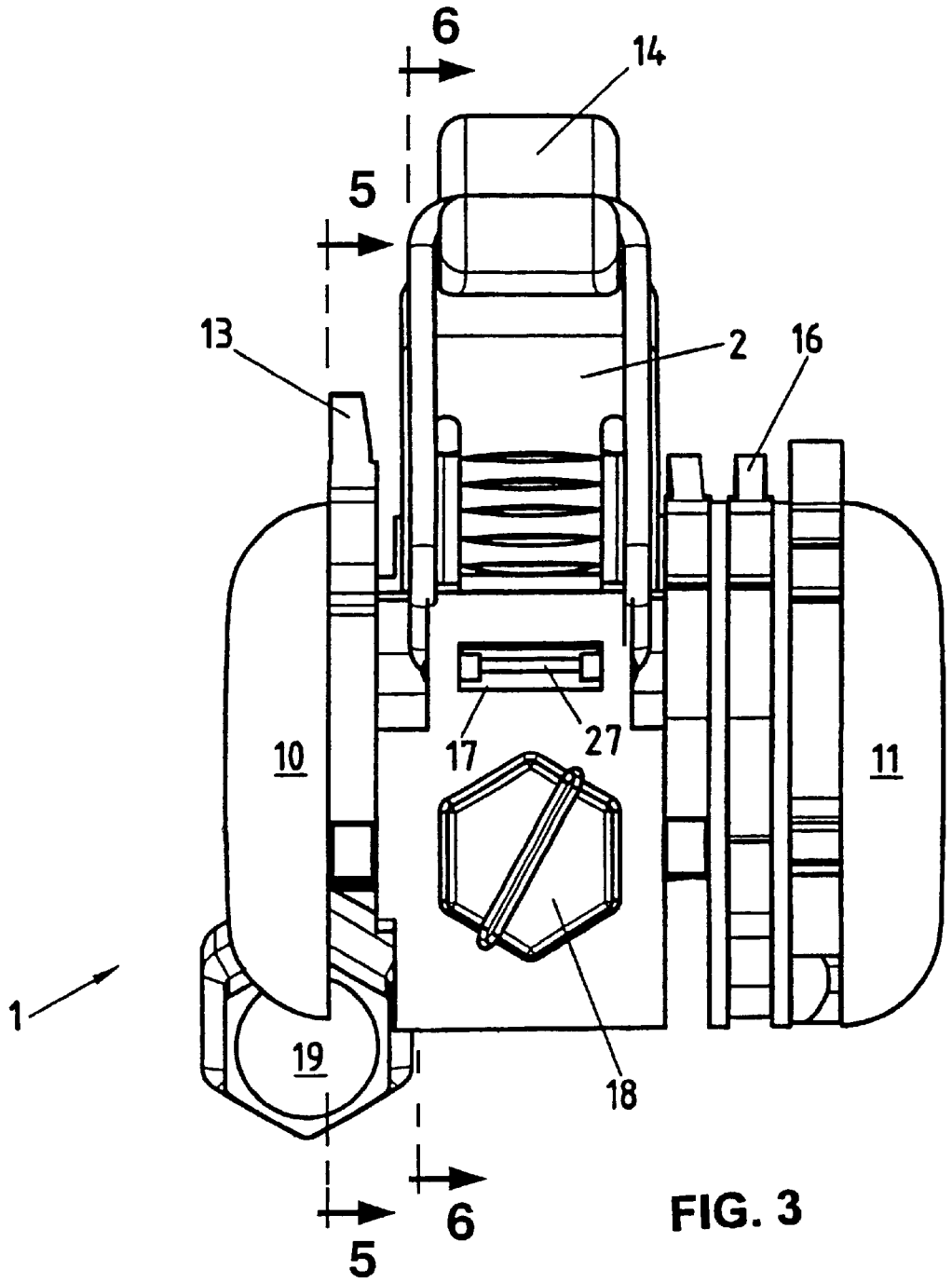
FIG. 3 is a view from behind of a knife/cutting pliers according to the invention with the pliers in closed position and a closed magazine lid.

The knife/cutting pliers 1 preferably comprises locking means 140 allowing the handle 14 of the pliers to be locked in the closed position illustrated in FIGS. 2 and 3. In this position, the lifting up of the magazine lid 2 is impossible. The locking means 140 therefore permits simultaneous locking of the magazine lid 2.

The lid 2 is preferably conceived in such a way as to protect completely the implements 30 to 35 and the interior space 12 from dust and grains of sand in closed position. The portion of the interior space 12 reserved for the removable implements 30 to 35 is itself preferably separated from the other implements 13, 15, 16 of the knife by suitable walls ensuring an improved impermeability.

The knife/cutting pliers 1 of the invention preferably further comprise an aperture 18 provided in this example at the longitudinal end of the knife and allowing the diverse implements 30 to 35 to be received. This arrangement enables the attachments to be operated with a moment of great force and without risk of an implement folding back into the interior of the knife. The tool can be reinforced, if necessary, near the aperture 18, for example by means of a metallic plate in such a way as to withstand the moments of great force which can be applied with screwing implements 30 to 35. An aperture 100 in a lateral side of the knife, as suggested in particular in the patent document EP 782903, already mentioned, can also be adopted. To facilitate handling of the attachments in places which are not very accessible, the knife/cutting pliers is preferably supplied with an attachment extension piece 19 fixed directly to the body of the knife, and which can be used in combination with one of the attachments 30 to 35 by disuniting it from the knife to introduce it, for example, into an aperture 18 or 100.

The knife/cutting pliers 1 of the invention can be supplied with a greater number of removable implements than the number of accommodations 20 to 25 in the lid 2, thus allowing the user to choose the implements as well as the attachment extension piece which he wants to carry, depending upon intended use. It is also possible to market implements adapted in an individual way. Finally, different magazine lids 2 provided with different types of accommodations can be used with the same knife/cutting pliers 1 in order to adapt it to transport different sets of implements. Lids 2 can thus be marketed independently from the knife/cutting pliers, equipped or not equipped with an assortment of suitable implements.

What is claimed is:

1. A multifunctional pocket tool, comprising:

two lateral sides, serving as a handle for the tool, an interior space being defined between said two lateral sides;

a magazine lid movable between a closed position that covers at least a portion of the interior space and an open position; and a plurality of removable implements accessible when the magazine lid is in the open position;

wherein the magazine lid defines accommodations having shapes corresponding to shapes of the removable implements so as to keep the removable implements in place.

2. The pocket tool according to claim 1, further comprising at least one other implement disposed between said lateral sides and being able to pivot about at least one transverse axis connecting said lateral sides.

3. The pocket tool according to claim 2, further comprising at least one flexible back blades and a face of said interior space opposite to that containing the magazine lid, the face being closed off by the at least one flexible back blades allowing said at least one other implement to be held in predefined positions.

4. The pocket tool according to claim 1, wherein at least one removable implement is only partially received in an accommodation of the magazine lid and partially in said interior space.

5. The pocket tool according to claim 4, wherein the removable implements arc structurally different from each other and each include a distinctive portion, said magazine lid including a plurality of identical accommodations that keep the removable implements in place such that the distinctive portion of each of the removable implements is received in said interior space.

6. The pocket tool according to claim 1, wherein said interior space comprises a plurality of hooking means intended to keep the removable implements in place.

7. The pocket tool according to claim 1, wherein the plurality of removable implements are disposed loosely in said interior space.

8. The pocket tool according to claim 7, wherein said magazine lid and said removable implements are entirely contained between planes defined by the said lateral sides.

9. The pocket tool according to claim 1, wherein said magazine lid is separable from the tool.

10. The pocket tool according to claim 9, wherein said magazine lid comprises a support area allowing it to be placed on a flat surface in such a way as to be able to have access to the removable implements.

11. The pocket tool according to claim 1, wherein said magazine lid is fixed to the tool by a hinge.

12. The pocket tool according to claim 1, wherein the magazine lid includes at least one flexible flange that communicates with at least one aperture to enable the magazine lid to be snapped on the tool.

13. The pocket tool according to claim 12, wherein said snapping system includes a deformable flexible element.

14. The pocket tool according to claim 1, further including a locking element that enables the magazine lid to be secured to the tool.

15. The pocket tool according to claim 1, wherein at least a part of each of the removable implements is disposed so as to be parallel relative to each of the other removable implements in said tool.

16. The pocket tool according to claim 15, wherein said parallel, removable implements are oriented obliquely with respect to the longitudinal axis of the tool.

17. The pocket tool according to claim 1, further comprising a surface that defines an aperture into which the end of one of the removable implements can be inserted.

18. The pocket tool according to claim 17, wherein said aperture is provided at one of the longitudinal ends of the tool.

19. The pocket tool according to claim 17, wherein said aperture is provided in one, of the lateral sides of the tool.

20. The pocket tool according to claim 1, further comprising an attachment extension piece detachably attached at one of the lateral sides.

21. The pocket tool according to claim 1, wherein the pocket tool is a pocket knife.

22. The pocket tool according to claim 21, wherein the pocket tool is a knife/cutting pliers, and further comprising pliers that include at least one actuation handle, the at least one actuation handle of the pliers folds up over said magazine lid.

23. A magazine lid for a multifunctional pocket tool, the pocket tool including two lateral sides, serving as a handle of the tool, an interior space defined between said sides, an aperture, and multiple removable implements received by the magazine lid, the magazine lid comprising:

at least one flexible flange that communicates with the at least one aperture to enable the magazine lid to be fixed to, and disunited from, said pocket tool;

wherein the magazine lid defines accommodations having shapes corresponding to shapes of the removable implements so as to keep the removable implements in place.

24. The magazine lid according to claim 23, further comprising a support surface allowing the magazine lid to be placed on a flat surface in such a way as to be able to have access to the removable implements.

25. The magazine lid according to claim 24, wherein said snapping system includes a deformable flexible element.

26. The magazine lid according to claim 23, further including a plurality of accommodations configured to keep the removable implements in place.

27. The magazine lid according to claim 26, wherein the plurality of accommodations all have substantially the same shape, each of the removable implements received by the plurality of accommodations including a distinctive portion that projects from the magazine lid.

28. The magazine lid according to claim 23, wherein at least a part of each of the removable implements is disposed so as to be parallel relative to each of the other removable implements.

29. The magazine lid according to claim 23, wherein said parallel, removable implements are oriented obliquely with respect to the longitudinal axis of the magazine lid.

30. A multifunctional pocket tool, comprising:

two lateral sides, serving as a handle for the tool, an interior space being defined between said two lateral sides;

a magazine lid movable between a closed position that covers at least a portion of the interior space and an open position, the magazine lid defining accommodations;

a hinge at an end of the magazine lid enabling the magazine lid to pivot about a transverse axis of the pocket tool between the closed and open positions;

a plurality of removable implements accessible when the magazine lid is in the open position, the removable implements being held by the accommodations within the interior space when the magazine lid is in the closed position, the removable implements being held by the accommodations by virtue of the accommodations having shapes corresponding to shapes of the removable implements;

at least one other implement disposed between the lateral sides and being able to pivot about at least one transverse axis connecting the lateral sides;

at least one flexible back blades; and a face of the interior space, opposite to that containing the magazine lid, being closed off by the at least one flexible back blades allowing said at least one other implement to be held in predefined positions.

31. The multifunctional pocket tool according to claim 30, wherein said hinge enables the magazine lid to be moved between three pre-defined positions at 0°, 90° and 180° relative to a longitudinal axis of the pocket tool.

32. The multifunctional pocket tool according to claim 30, wherein said accommodations and said magazine lid are disposed so that said removable implements are only accessible when said removable lid is in the open position.

33. The multifunctional pocket tool according to claim 30, wherein said implements are arranged in a plane parallel to said lateral sides, so as to occupy only a single implement thickness in the interior space, and are disposed obliquely relative to a longitudinal axis of the tool, making it possible to house in said interior space removable implements having a length greater than a height of said interior space, each removable implement having a protruding portion enabling the removable implement to be distinguished visually from other removable implements.

34. The multifunctional pocket tool according to claim 30, further comprising snapping means for holding said removable implements.

35. The multifunctional pocket tool according to claim 30, wherein each of said removable implements has a hexagonal base.

36. The multifunctional pocket tool according to claim 30, wherein said at least one other implement includes a tool blade, a can opener and a bottle opener.

37. The multifunctional pocket tool according to claim 30, further comprising tweezers housed in said lateral sides.

38. The multifunctional pocket tool according to claim 30, further comprising an aperture having a shape so as to be able to receive an end of at least one of the removable implements.

39. The multifunctional pocket tool according to claim 30, further comprising an implement extension usable with at least one of said removable implements in order to enhance use of the at least one of the removable implements in areas that are difficult to reach.

40. A multifunctional pocket tool, comprising:

a pair of sides that define an interior space therebetween;

a lid movable between a closed position that covers at least a portion of the interior space and an open position;

multiple accommodations defined in the interior space;

multiple removable implements accessible when the lid is in the open position, each of the removable implements being held by one of the accommodations within the interior space so as to extend obliquely with respect to a longitudinal direction of the sides, the removable implements being held by the accommodations by virtue of the accommodations having shapes corresponding to shapes of the removable implements.

41. The pocket tool according to claim 40, wherein the removable implements extend substantially parallel relative to each other when held by the accommodations.

42. The pocket tool according to claim 40, wherein each of the removable implements has a distinctive portion that projects beyond the corresponding accommodation so as to enable identification of each of the removable implements.

43. The pocket tool according to claim 40, wherein all of the accommodations have substantially the same shape.

44. A multifunctional pocket knife, comprising:

two lateral sides serving as a handle for the knife, the two lateral sides defining an interior space therebetween;

a plurality of first implements disposed side by side between said two lateral sides, the two lateral sides being pivotable about at least one transverse axis that intersects the two lateral sides;

a plurality of removable implements disposed parallel to each other and side by side relative to said first implements in said interior space, said removable elements being oriented obliquely with respect to a longitudinal axis of the tool, a magazine cover movable between a closed position wherein the magazine cover covers at least a portion of the interior space and an open position enabling access to the removable implements, the magazine cover being movable from the closed position to the open position by being manually lifted upwardly;

at least one flexible back blades closing off a section of said interior space opposite to another section that houses the magazine cover, the at least one flexible back blades enabling the plurality of first implements to be held in predefined positions.

45. The multifunctional pocket knife according to claim 44, wherein said magazine cover includes a plurality of accommodations having shapes corresponding to shapes of the removable implements so as to maintain the removable implements in place, at least one removable implement having a distinctive portion and being only partially received in an accommodation of the magazine cover and partially in said interior space, the distinctive portion of said at least one implement being received in said interior space.

46. The multifunctional pocket knife according to claim 44, further comprising a deformable flexible element that snaps said magazine cover on said knife.

47. A multifunctional pocket knife, comprising:

two lateral sides, serving as handles for the pocket knife, the two lateral sides defining an interior space therebetween;

a hinge pivotable about an axis that is transverse to the pocket knife;

a magazine cover having an end and being integrally attached to the knife by the hinge at the end, the magazine cover being movable between an open position and a closed position wherein the magazine cover covers at least a portion of the interior space;

multiple accommodations;

multiple removable implements held by the accommodations inside said interior space by virtue of the accommodations having shapes corresponding to shapes of the removable implements;

at least one other implement disposed between said two lateral sides and pivotable about at least one transverse axis that intersects the two lateral sides; and at least one flexible spring blades disposed at a section of the interior space opposite to another section that houses the magazine cover, the at least one flexible spring blades enabling said at least one other implement to be held in predefined positions.

48. The multifunctional pocket knife according to claim 47, wherein said at least one flexible spring blades enable the magazine cover to be moved among three predefined positions at 0°, 90° or 180° relative to the longitudinal axis of the knife.

49. The multifunctional pocket knife according to claim 47, wherein said accommodations and said magazine cover are disposed to only enable said removable implements to be accessible when said magazine cover is in the open position.

50. The multifunctional pocket knife according to claim 47, wherein at least one of the removable implements has a length that is greater than a height of the pocket knife, said removable implements being arranged in a plane parallel to said two lateral sides so as to occupy only a single implement thickness in the pocket knife, the removable implements also being arranged obliquely relative to the longitudinal axis of the knife, thereby enabling insertion into said interior space of the at least one removable implement having a length greater than the height of said pocket knife, each of the removable implements having a protruding portion enabling each of the respective removable implements to be distinguished visually from other of the removable implements.

51. The multifunctional pocket knife according to claim 50, wherein each of said removable implements has a hexagonal base.

52. The multifunctional pocket knife according to claim 47, wherein said at least one other implement includes a knife blade, a can opener and a bottle opener.

53. The multifunctional pocket knife according to claim 47, further comprising tweezers housed in said two lateral sides.

54. The multifunctional pocket knife according to claim 47, further comprising an aperture structured to receive an end of at least one of said removable implements.

55. The multifunctional pocket knife according to claim 47, further comprising an implement extension structured for use in combination with at least one of said removable implements to facilitate manipulation in areas that are difficult to reach.

* * * * *